US010338504B2

(12) United States Patent
Shimohora

(10) Patent No.: US 10,338,504 B2
(45) Date of Patent: Jul. 2, 2019

(54) FIXING DEVICE AND IMAGE FORMING APPARATUS INCLUDING THE SAME

(71) Applicant: KYOCERA Document Solutions Inc., Osaka (JP)

(72) Inventor: Yuya Shimohora, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/981,152

(22) Filed: May 16, 2018

(65) Prior Publication Data

US 2018/0348679 A1 Dec. 6, 2018

(30) Foreign Application Priority Data

Jun. 5, 2017 (JP) ..... 2017-110954

(51) Int. Cl.
*G03G 15/20* (2006.01)

(52) U.S. Cl.
CPC ..... *G03G 15/2035* (2013.01); *G03G 15/2028* (2013.01)

(58) Field of Classification Search
None
See application file for complete search history.

(56) References Cited

U.S. PATENT DOCUMENTS 5,623,720 A * 4/1997 Howe ..... G03G 15/2028 399/323
6,549,740 B2 4/2003 Yoneda et al.
8,725,039 B2 * 5/2014 Tanda ..... G03G 15/2035 399/122
2014/0193180 A1 * 7/2014 Hasegawa ..... G03G 15/2028 399/323

FOREIGN PATENT DOCUMENTS

JP 2002-244475 A 8/2002
JP 2008083471 A * 4/2008

OTHER PUBLICATIONS

English machine translation of JP2008083471A.*

* cited by examiner

*Primary Examiner* — David M. Gray
*Assistant Examiner* — Geoffrey T Evans
(74) *Attorney, Agent, or Firm* — Studebaker & Brackett PC

(57) ABSTRACT

A fixing device includes a fixing member, a pressing member, a cover, and a separation member. The cover is movable between a closing position at which a conveyance path is formed and an opening position at which the conveyance path is exposed. The cover includes a recess. The separation member is movable between a contact position at which the separation member comes in contact with a face of the fixing member and a withdrawing position at which the separation member is separated from the fixing member. The separation member separates a medium from the face of the fixing member in a state in which the separation member is arranged at the contact position. A tip end part of the separation member enters an interior of the recess of the cover in a state in which the separation member is arranged at the withdrawing position.

7 Claims, 8 Drawing Sheets

FIXING DEVICE AND IMAGE FORMING APPARATUS INCLUDING THE SAME

INCORPORATION BY REFERENCE

This application is based on and claims the benefit of priority from Japanese patent application No. 2017-110954 filed on Jun. 5, 2017, which is incorporated by reference in its entirety.

BACKGROUND

The present disclosure relates to a fixing device and an image forming apparatus including the same.

An electrographic image forming apparatus includes a fixing device that fixes a toner image on a medium while heating and pressing the toner image.

For example, the fixing device includes a heating roller, a pressing roller that comes in contact with the heating roller, and a separation member that separates a sheet from the heating roller. A guiding member for guiding the conveying direction of a sheet that has passed between the heating roller and the pressing roller (a pair of rollers) is attached to an opening-and-closing unit of an image forming apparatus. The guiding member is configured to move in synchronization with the opening-and-closing operation of the opening-and-closing unit, thereby causing the separation member to come into contact with or be withdrawn from the heating roller.

SUMMARY

In accordance with an aspect of the present disclosure, a fixing device includes a fixing member, a pressing member, a cover, and a separation member. The fixing member heats a toner on a medium while rotating. The pressing member forms a pressing area between the fixing member and the pressing member while rotating and presses the toner on the medium passing through the pressing area. The cover is movable between a closing position at which a conveyance path to convey the medium is formed and an opening position at which the conveyance path is exposed. The cover includes a recess on a side of the conveyance path. The separation member is movable between a contact position at which the separation member comes in contact with a face of the fixing member in a state in which the cover is arranged at the closing position and a withdrawing position at which the separation member is separated from the fixing member in a state in which the cover is arranged at the opening position. The separation member separates the medium from the face of the fixing member in a state in which the separation member is arranged at the contact position. A tip end part of the separation member enters an interior of the recess of the cover in a state in which the separation member is arranged at the withdrawing position.

In accordance with an aspect of the present disclosure, an image forming apparatus includes the fixing device.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

Figure 1:
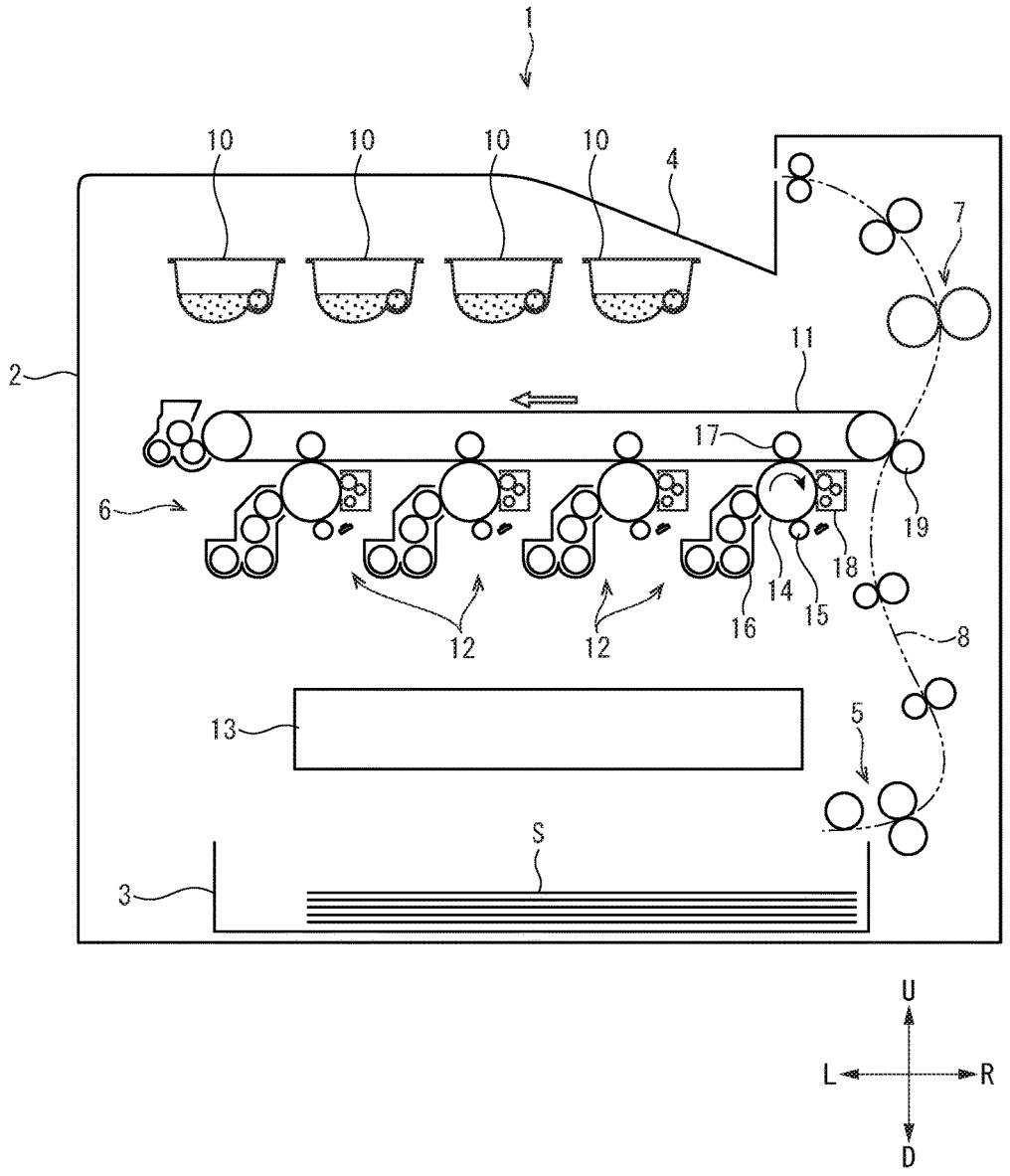
FIG. 1 is a sectional view schematically illustrating the internal structure of a printer according to one embodiment of the present disclosure.

Hereinafter, one embodiment of the present disclosure will be described with reference to attached drawings. In FIG. 1 and other drawings, a near side of a sheet corresponds to a front side, and in each drawing, "L" denotes "left", "R" denotes "right", "U" denotes "up", and "D" denotes "down".

[Outline of Color Printer]

The entire configuration of a color printer 1 as one example of an image forming apparatus will be described with reference to FIG. 1. FIG. 1 is a sectional view schematically illustrating the internal structure of the color printer 1.

The color printer 1 includes an apparatus main body 2 the exterior of which is formed in an approximately rectangular parallelepiped. A sheet feeding cartridge 3 for storing sheets S (medium) made of paper is detachably provided on the lower side of the apparatus main body 2. A sheet ejecting tray 4 is provided on the upper side of the apparatus main body 2. The sheets S are not limited to sheets made of paper but may include sheets made of resin.

In addition, the color printer 1 includes a sheet feeding device 5, an image forming device 6, and a fixing device 7 in the interior of the apparatus main body 2. The sheet feeding device 5 is provided on an end part on the upstream of a conveyance path 8 extending from the sheet feeding cartridge 3 to the sheet ejecting tray 4. The fixing device 7 is provided on the downstream side of the conveyance path 8, and the image forming device 6 is provided between the sheet feeding device 5 and the fixing device 7 on the conveyance path 8.

The image forming device 6 includes four toner containers 10, an intermediate transferring belt 11, four drum units 12, and an optical scanning device 13. The intermediate transferring belt 11 rotates in a direction illustrated by an arrow in FIG. 1. The four toner containers 10 contains a developer including toners of four colors (yellow, magenta, cyan, and black). The developer, for example, is a two-component developer composed of the mixture of a toner and a carrier. Each drum unit 12 includes a photosensitive drum 14, a charging device 15, a developing device 16, a primary transferring roller 17, and a cleaning device 18. Each primary transferring roller 17 is provided in such a manner that the intermediate transferring belt 11 is sandwiched between each primary transferring roller 17 and each photosensitive drum 14. A secondary transferring roller 19 comes in contact with the right side of the intermediate transferring belt 11, thereby forming a transferring nip.

The color printer 1 executes image forming processing as described below. Each charging device 15 electrically charges the face of each photosensitive drum 14. Each photosensitive drum 14 receives scanning light emitted from the optical scanning device 13 and carries an electrostatic latent image. Each developing device 16 develops the electrostatic latent image into a toner image on each photosensitive drum 14 by using the toner supplied from each toner container 10. Each primary transferring roller 17 primarily transfers the toner image on each photosensitive drum 14 onto the intermediate transferring belt 11 being rotated. The intermediate transferring belt 11 carries a full-color toner image on which toner images of four colors are stacked while rotating. The sheet S is sent by the sheet feeding device 5 from the sheet feeding cartridge 3 to the conveyance path 8. The secondary transferring roller 19 secondarily transfers the toner image on the intermediate transferring belt 11 to the sheet S passing through the transferring nip. The fixing device 7 thermally fixes the toner image on the sheet S. Subsequently, the sheet S is discharged to the sheet ejecting tray 4. Each cleaning device 18 removes the toner left on each photosensitive drum 14.

[Fixing Device]

Figure 2:
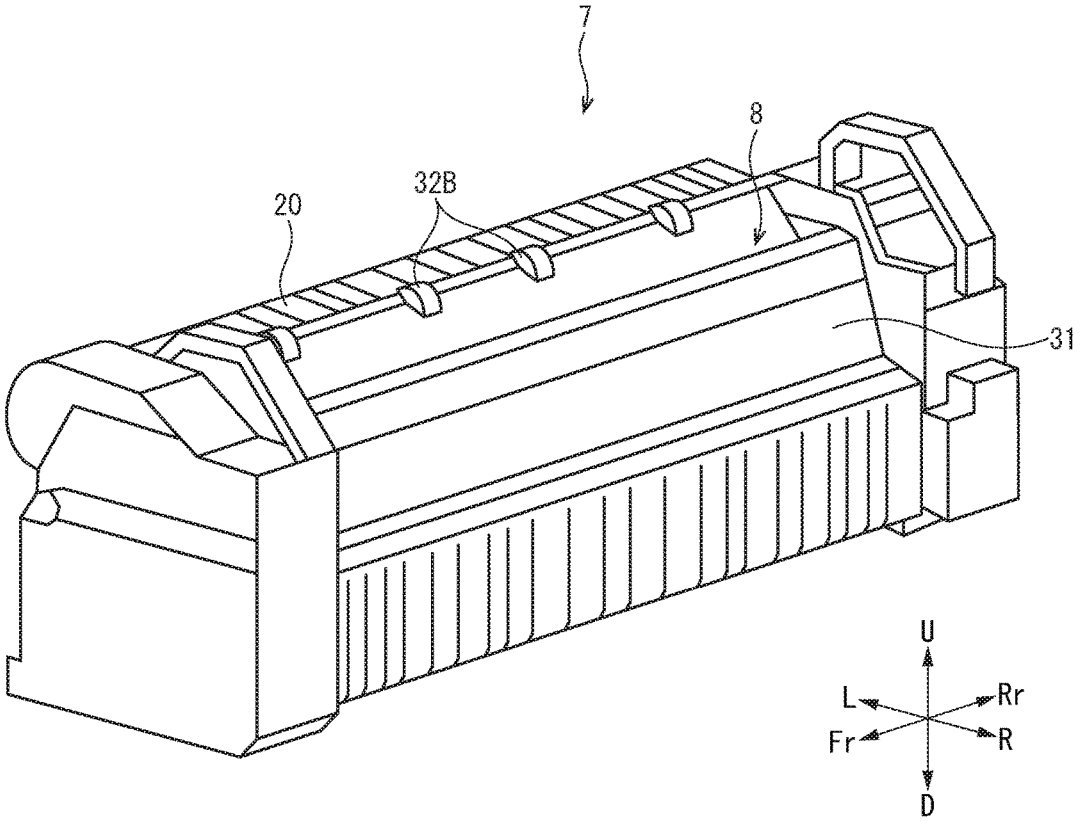
FIG. 2 is a perspective view illustrating a fixing device according to the one embodiment of the present disclosure.
Figure 3:
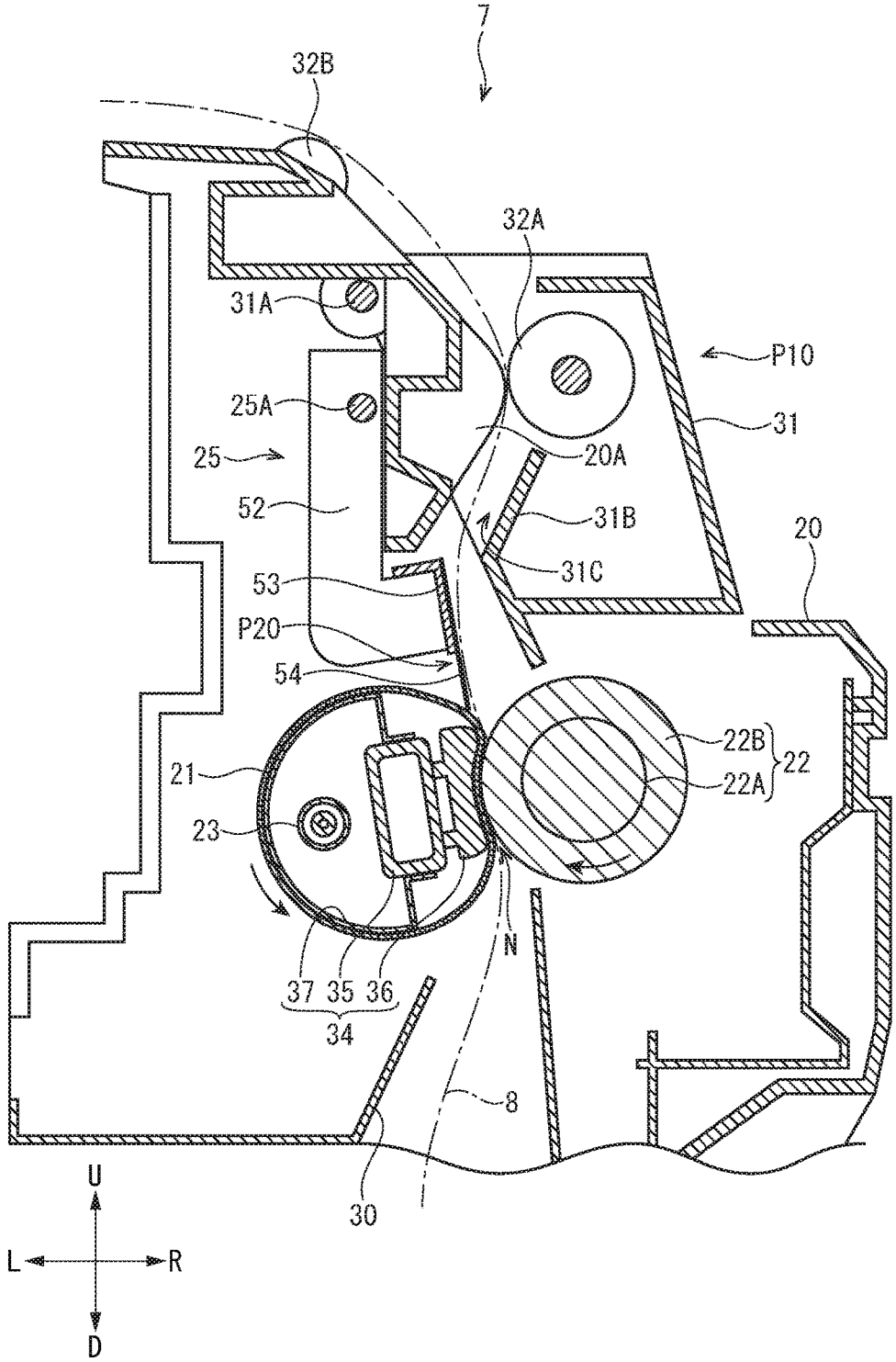
FIG. 3 is a sectional view schematically illustrating the fixing device according to the one embodiment of the present disclosure.
Figure 4:
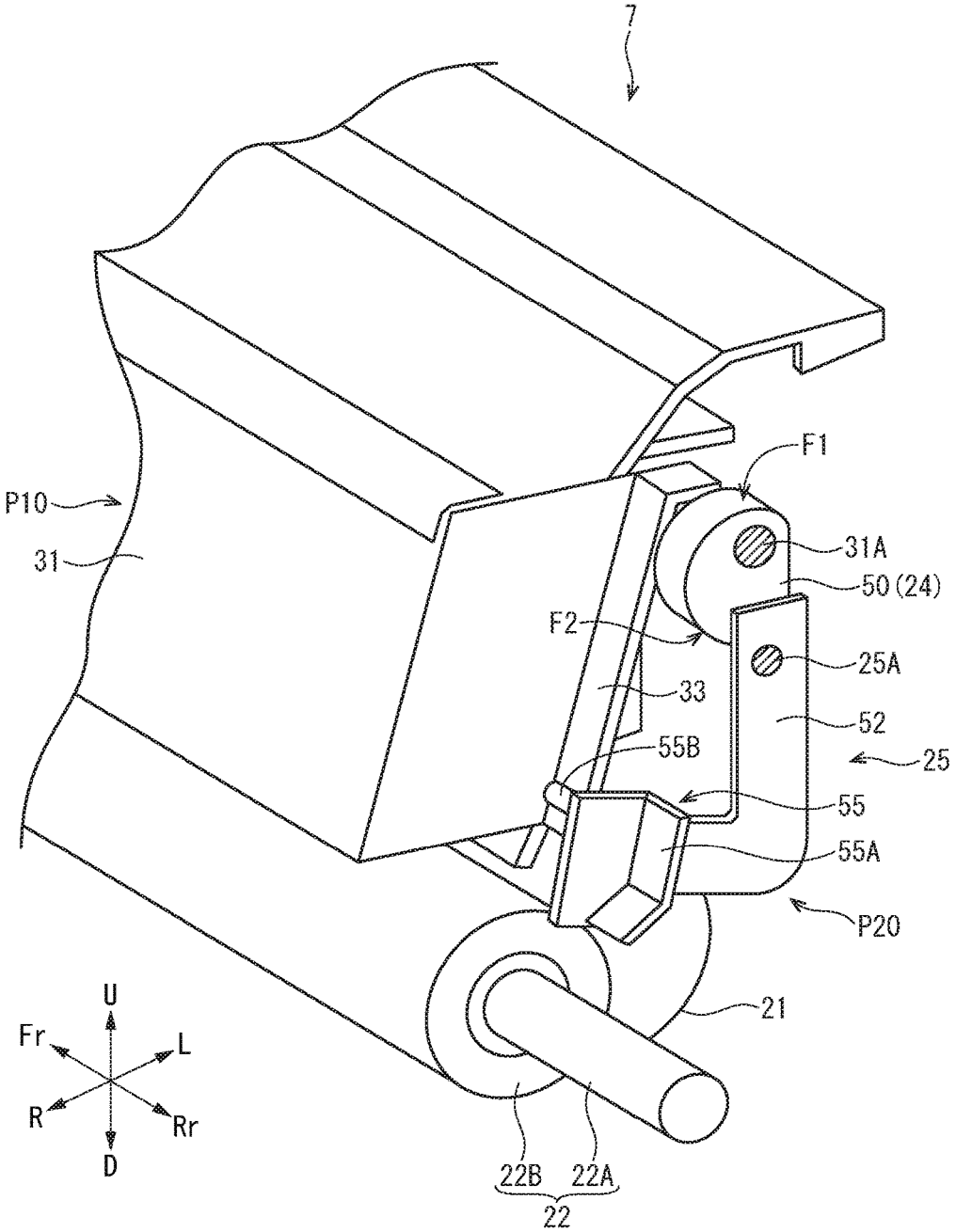
FIG. 4 is a perspective view illustrating a rear side of the fixing device according to the one embodiment of the present disclosure.
Figure 5:
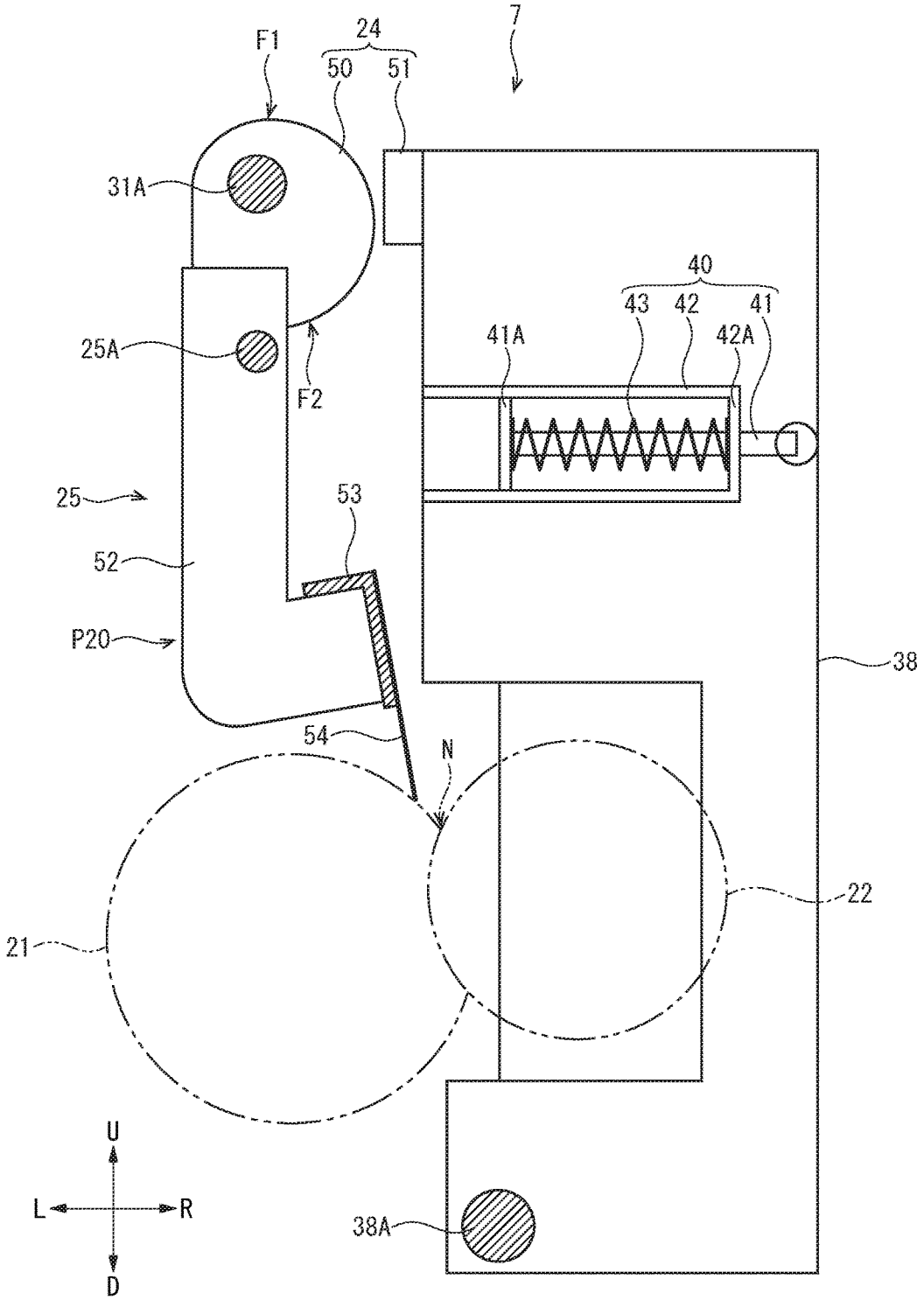
FIG. 5 is a front view schematically illustrating the interior of the fixing device according to the one embodiment of the present disclosure.
Figure 6:
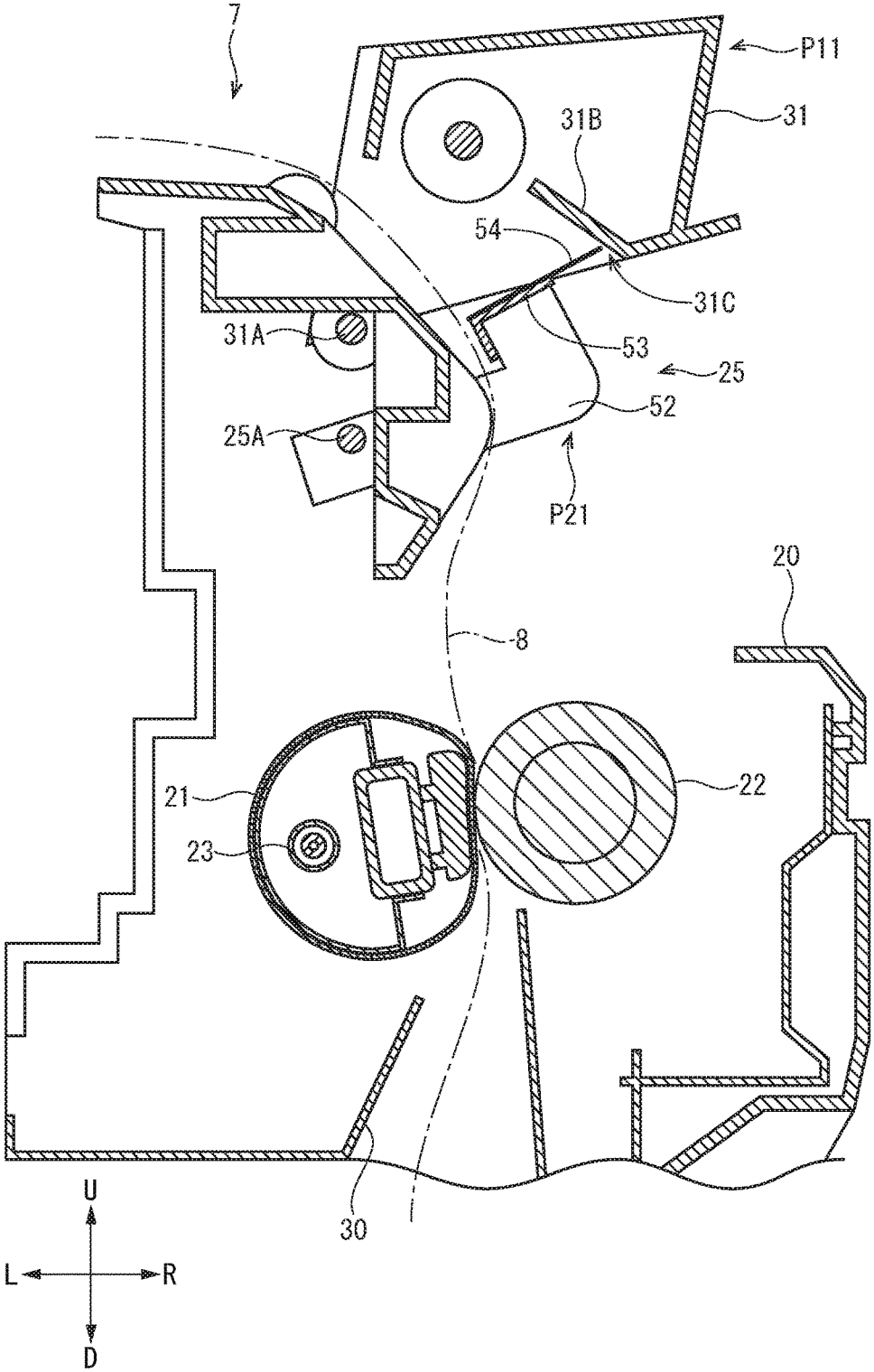
FIG. 6 is a sectional view schematically illustrating a state in which a cover of the fixing device according to the one embodiment of the present disclosure is opened.

Next, the fixing device 7 will be described with reference to FIGS. 2 to 6. FIG. 2 is a perspective view illustrating the fixing device 7. FIG. 3 is a sectional view schematically illustrating the fixing device 7. FIG. 4 is a perspective view illustrating a rear side of the fixing device 7. FIG. 5 is a front view schematically illustrating the interior of the fixing device 7. FIG. 6 is a sectional view schematically illustrating a state in which a cover 31 of the fixing device is opened. In the Description, terms "upstream" and "downstream" and terms similar to these represent "upstream" and "downstream" in the conveying direction of the sheet S and concepts similar to these.

The fixing device 7 employs a belt fixing manner using a fixing belt 21 with low heat capacity in order to reach a setting temperature in a short period of time. As illustrated in FIGS. 2 to 4, the fixing device 7 includes a casing 20, the fixing belt 21, a pressing roller 22, a halogen heater 23, a pressure releasing part 24, and a separation member 25. The casing 20 is supported by the apparatus main body 2. The fixing belt 21, the pressing roller 22, the pressure releasing part 24, and the separation member 25 are provided in the interior of the casing 20. The halogen heater 23 is provided in the interior of the fixing belt 21.

<Casing>

As illustrated in FIGS. 2 and 3, the casing 20 is formed in an approximately rectangular parallelepiped elongated in a front-and-rear direction. A part of the conveyance path 8 through which the sheet S passes is formed in the interior of the casing 20. Openings communicated with the conveyance path 8 in the casing 20 are formed on the lower face and the upper face of the casing 20. An entry guide 30 for guiding the sheet S to a contact section (pressing area N) between the fixing belt 21 and the pressing roller 22 is provided in the vicinity of the opening on the lower face side of the casing 20 (see FIG. 3).

(Cover)

As illustrated in FIGS. 2 to 4, the cover 31 for being opened and closed in a case in which the sheet S jammed in the casing 20 is removed (jamming process) is provided on the right side of the upper part of the casing 20. The cover 31, for example, is made of synthetic resin and formed in an approximately rectangular parallelepiped elongated in the front-and-rear direction. More specifically, the cover 31 is formed in an approximately parallelogram inclined in the left direction when viewed from the front. The cover 31 is provided at the downstream side of the pressing area N.

As illustrated in FIGS. 3 and 4, an opening-and-closing shaft 31A extended in the front-and-rear direction is fixed to an upper left corner part of the cover 31. Both front and rear end parts of the opening-and-closing shaft 31A are rotatably supported by the side walls of the casing 20. The cover 31 rotates around the opening-and-closing shaft 31A. More specifically, the cover 31 is movable (rotatable) between a closing position P10 (see FIG. 3) at which the conveyance path 8 for conveying the sheet S that has passed through the pressing area N is formed, and an opening position P11 (see FIG. 6) at which the conveyance path 8 is exposed. When the cover 31 rotates upward from the closing position P10 to the opening position P11, the conveyance path 8 in the casing 20 is exposed (see FIG. 6). In the description below, an explanation is given using a state in which the cover 31 is arranged at the closing position P10 as a reference.

As illustrated in FIG. 3, a cover conveying face part 31B is formed on the upstream side (lower part) of the cover 31 with the conveyance path 8 sandwiched between the cover conveying face part 31B and a main body conveying face part 20A fixed to the interior of the casing 20 while the cover conveying face part 31B is opposing the main body conveying face part 20A. The cover conveying face part 31B is formed in a state of being inclined to the hollow interior (right direction) of the cover 31 from the lower part to the upper part. The cover conveying face part 31B is formed in such a manner as to be recessed, thereby forming a recess 31C on the side of the conveyance path 8 of the cover 31. An opening communicated with the interior of the cover 31 is formed at the downstream side of the cover conveying face part 31B (recess 31C), and a first discharging roller 32A for sending the sheet S having passed through the pressing area N to the downstream side is provided in the opening. Second discharging rollers 32B are provided on the upper face of the casing 20 (see FIG. 2).

In addition, as illustrated in FIG. 4, a pair of cam parts 33 is formed at both ends in the front-and-rear direction (axial direction) of the cover 31. The cam parts 33 are formed in a state of protruding from the left edge part of the cover 31 to the outside in the front-and-rear direction. The cam parts 33 are formed in a state of being inclined to the left direction from the lower part to the upper part.

<Fixing Belt>

As illustrated in FIGS. 3 and 4, the fixing belt 21 as one example of a fixing member is an endless belt and formed in an approximately cylindrical shape elongated in the front-and-rear direction. The fixing belt 21, for example, is formed of synthetic resin having heat resistance and elasticity. The fixing belt 21 is supported by the casing 20 to rotate around an axis.

As illustrated in FIG. 3, a pressing structure 34 for receiving pressure from the pressing roller 22 is provided in the interior of the fixing belt 21. The pressing structure 34 includes a pressing support member 35, a pressing pad 36, and a belt guide 37.

The pressing support member 35, for example, is made of metal and formed in an approximately rectangular cylindrical shape elongated in the front-and-rear direction. A reflective member (not illustrated) for reflecting the light of the halogen heater 23 is fixed to the left face of the pressing support member 35. The pressing pad 36, for example, is made of synthetic resin having heat resistance and formed in an approximately rectangular parallelepiped elongated in the front-and-rear direction. The pressing pad 36 is fixed to the right face of the pressing support member 35 and supports the fixing belt 21 pressed by the pressing roller 22. A sliding sheet (not illustrated) for reducing friction with the fixing belt 21 is fixed to the face of the pressing pad 36. The belt guide 37, for example, is made of metal and formed in an approximately semi-cylindrical shape elongated in the front-and-rear direction. The belt guide 37 is fixed to the pressing support member 35 and presses the fixing belt 21 leftward, thereby keeping the fixing belt 21 in an approximately cylindrical shape.

<Pressing Roller>

As illustrated in FIGS. 3 and 4, the pressing roller 22 as one example of a pressing member is formed in an approximately cylindrical shape elongated in the front-and-rear direction. The pressing roller 22 is formed by stacking an elastic layer 22B such as a silicone sponge on the outer circumferential face of a metal core 22A made of metal.

As illustrated in FIG. 5, both front and rear end parts of the pressing roller 22 (metal core 22A) are rotatably supported by a pair of movable frames 38 (frames). A rotating shaft 38A extended in the front-and-rear direction is fixed to the lower parts of the movable frames 38. Both front and rear end parts of the rotating shaft 38A are rotatably supported by the side walls of the casing 20. The movable frames 38 rotate around the rotating shaft 38A. The pressing roller 22 is connected to a driving motor (not illustrated) via a gear train or the like.

The pressing roller 22 is pressed by a pressing mechanism 40 against the fixing belt 21. The pressing mechanism 40 includes a pair of front and rear fixing shafts 41, a pair of front and rear working members 42, and a pair of front and rear coil springs 43. Hereinafter, regarding an explanation common to each member provided as a pair of front and rear members, one rear member is focused and appropriately described.

The pair of front and rear fixing shafts 41 is arranged on the inside of the pair of movable frames 38 in a posture extended in a left-and-right direction. One end part (right end part) of the fixing shaft 41 is fixed to the upper part (above the pressing roller 22) of the movable frame 38. A flange-shaped fixed contact part 41A is fixed to the other end part (left end part) of the fixing shaft 41.

The working member 42 is supported by the casing 20 so that the working member 42 is movable in the left-and-right direction. The working member 42 is formed in a hollow box-like shape to contain the fixing shaft 41 (fixed contact part 41A). A movable contact part 42A facing the fixed contact part 41A is formed on one end face (right end face) of the working member 42. A hole (not illustrated) through which the fixing shaft 41 penetrates is formed in the movable contact part 42A.

The coil spring 43 (compression spring) is provided in such a manner as to wind around the fixing shaft 41. Both right and left end parts of the coil spring 43 come in contact with the fixed contact part 41A and the movable contact part 42A, respectively. The coil spring 43 biases the fixed contact part 41A and the movable contact part 42A in a direction in which the fixed contact part 41A and the movable contact part 42A separate from each other. The coil spring 43 biases the fixed contact part 41A (fixing shaft 41) in the left direction, which causes the movable frame 38 to rotate around the rotating shaft 38A counterclockwise and causes the pressing roller 22 to be pressed against the fixing belt 21.

As described above, the pressing roller 22 is pressed against the fixing belt 21, thereby forming the pressing area N between the fixing belt 21 and the pressing roller 22 (see FIG. 3). The pressing area N is defined by areas ranging from a position on the upstream side at which pressure reaches 0 Pa to a position on the downstream side at which pressure reaches 0 Pa again via a position at which pressure reaches the maximum. The pressure applied to the pressing area N, under which the toner on the sheet S is pressed (the toner image is fixed to the sheet S), is referred to as "first pressure". The pressing mechanism 40 includes a pressure changing mechanism including cams that come in contact with the other end parts (left end parts) of the working members 42, although its illustration is omitted. The pressure changing mechanism causes the cams to rotate, which enables the working members 42 to move in the left-and-right direction and changes (adjusts) biasing force of the coil springs 43.

<Halogen Heater>

As illustrated in FIG. 3, the halogen heater 23 includes a halogen lamp that emits light in an infrared region and heats the fixing belt 21. The halogen heater 23 is formed in an approximately rod shape elongated in the front-and-rear direction and provided in such a manner as to penetrate the interior of the fixing belt 21 in the axial direction. The halogen heater 23 is arranged between the belt guide 37 and the pressing support member 35 when viewed from the front. In the present embodiment, the halogen heater 23 is employed as a heat source, but in place of this, a carbon heater or the like may be employed.

Temperature sensors (not illustrated) such as a thermopile and a thermistor for detecting a temperature of the face of the fixing belt 21 are provided in the interior of the casing 20. The driving motor, the halogen heater 23, and the temperature sensors are electrically connected to the control device of the color printer 1. The control device controls the driving motor, the halogen heater 23, and the temperature sensors via various driving circuits.

<Pressure Releasing Part>

As illustrated in FIG. 5, the pressure releasing part 24 includes a pair of front and rear eccentric cams 50 and a pair of front and rear contact face parts 51. The pressure releasing part 24 is a mechanism for setting the pressure of the pressing area N to second pressure which is lower than the first pressure.

As illustrated in FIGS. 4 and 5, the pair of eccentric cams 50 is fixed to both end parts in the front-and-rear direction (axial direction) of the opening-and-closing shaft 31A. The eccentric cam 50 is what is called a disc cam in which a distance from an axis of the opening-and-closing shaft 31A to a cam face (circumferential face) is not uniform. The cam face of the eccentric cam 50 includes a proximity cam face F1 formed at a position close to the opening-and-closing shaft 31A and a separation cam face F2 formed at a position far from the opening-and-closing shaft 31A, compared with the proximity cam face F1. As illustrated in FIG. 5, the pair of contact face parts 51 is fixed to the upper part of the left end face of the pair of front and rear movable frames 38. The contact face part 51 is formed in an approximately rectangular parallelepiped and provided at a position facing the eccentric cam 50. The eccentric cam 50 is contactable with the contact face part 51 of the movable frame 38. Specifically, the eccentric cam 50 is provided at a position where the proximity cam face F1 does not come in contact with the contact face part 51, and the separation cam face F2 comes in contact with the contact face part 51.

<Separation Member>

As illustrated in FIGS. 3 to 5, the separation member 25 includes a pair of front and rear arm parts 52, a separation support member 53, a plurality of separation plates 54, and a pair of front and rear contact parts 55. The separation member 25 is a member for separating the sheet S having passed through the pressing area N from the face of the fixing belt 21. The separation member 25 is provided at the downstream side of the pressing area N.

The pair of arm parts 52 is arranged above the fixing belt 21. The arm part 52, for example, is made of metal and formed in an approximately L shape made by bending the lower end part of a plate extended in an up-and-down direction to the right (the side of the pressing roller 22). The pair of arm parts 52 is fixed to both front and rear end parts of a separation shaft 25A extended in the front-and-rear direction. The separation shaft 25A is arranged right below (downward) the opening-and-closing shaft 31A of the cover 31. Both front and rear end parts of the separation shaft 25A are rotatably supported by the side walls of the casing 20. The pair of arm parts 52 is configured to rotate around the separation shaft 25A. Torsion coil springs (not illustrated) for biasing the pair of arm parts 52 clockwise in FIG. 3 are attached to both front and rear end parts of the separation shaft 25A.

As illustrated in FIGS. 3 and 5, the separation support member 53, for example, is made of metal and formed in an approximately rod shape extended in the front-and-rear direction. The separation support member 53 has an approximately L-shaped cross section made by bending the upper end part of a plate extended in the front-and-rear direction to the left. Both front and rear end parts of the separation support member 53 are fixed (coupled) to the bent tip end parts of the pair of arm parts 52. That is, the separation support member 53 is bridged between the pair of arm parts 52.

The plurality of separation plates 54 are fixed to the separation support member 53 with a predetermined interval in the front-and-rear direction. The separation plate 54, for example, is made of metal and formed in a thin plate-like shape. The separation plate 54 is provided in a state of being extended from the separation support member 53 to the pressing area N. The separation plate 54 is arranged in such a manner that its tip end part comes in contact with the face of the fixing belt 21.

As illustrated in FIG. 4, the pair of contact parts 55 is provided on the bent tip end parts of the pair of arm parts 52. The contact part 55 includes a bracket part 55A and a contact boss 55B. The bracket part 55A, for example, is made of metal and formed in an approximately L shape with one plate extended in parallel to the arm part 52 and another plate extended from the base end part of the one plate to the outside in the front-and-rear direction. The contact boss 55B protrudes from the one plate extended in parallel to the arm part 52 of the bracket part 55A to the inside in the front-and-rear direction. The contact boss 55B, for example, is made of metal and formed in an approximately cylindrical shape and comes in contact with the cam part 33 (the right side of the cam part 33) of the cover 31.

The contact boss 55B is engaged with the cam part 33 of the cover 31, so that the separation member 25 (the arm part 52) rotates around the separation shaft 25A in synchronization with an opening and closing of the cover 31. Specifically, the separation member 25 (separation plate 54) is movably (rotatably) provided between a contact position P20 (see FIG. 3) at which the separation member 25 comes in contact with the face of the fixing belt 21 in a state in which the cover 31 is arranged at the closing position P10 and a withdrawing position P21 (see FIG. 6) at which the separation member 25 is separated from the face of the fixing belt 21 in a state in which the cover 31 is arranged at the opening position P11. In a state in which the separation member 25 is arranged at the contact position P20, the bracket part 55A comes in contact with a rotation regulating part provided on the casing 20 or a bearing of the pressing roller 22 (both of them are not illustrated). This regulates the rotation of the arm part 52 due to the biasing force of the torsion coil spring, thereby holding the separation member 25 at the contact position P20. As a result, contact pressure and a contact angle between the tip end part of the separation plate 54 and the fixing belt 21 can be kept approximately constant.

[Action of Fixing Device]

Hereinafter, the action (fixing processing) of the fixing device 7 will be described. When the fixing processing (image forming processing) is executed, the cover 31 is arranged at the closing position P10 (see FIG. 3). The pressure releasing part 24 sets pressure applied to the pressing area N to the first pressure in a state in which the cover 31 is arranged at the closing position P10 (see FIG. 5). Specifically, the proximity cam face F1 of the eccentric cam 50 faces the contact face part 51 with a gap, so that the pressing roller 22 is brought into a state of being pressed against the fixing belt 21 by the biasing force of the coil spring 43. In this state, the pressure applied to the pressing area N is set to the first pressure. Further, the separation member 25 is arranged at the contact position P20, and the tip end part of the separation plate 54 comes in contact with the face of the fixing belt 21 (see FIG. 3).

First, the control device controls the drive of the driving motor or the halogen heater 23. The pressing roller 22 receives the driving force of the driving motor and rotates, and the fixing belt 21 is driven to rotate by the pressing roller 22 (see an arrow in FIG. 3). The halogen heater 23 heats the fixing belt 21 from the interior of the fixing belt 21. The temperature sensor detects a temperature of the fixing belt 21 and transmits a detection signal to the control device via an input circuit. When receiving the detection signal, indicating that the temperature of the fixing belt 21 reaches a preset temperature, from the temperature sensor, the control device starts the execution of the image forming processing that has been described above. The sheet S on which the toner image is transferred enters the casing 20, and the fixing belt 21 heats the toner (toner image) on the sheet S passing through the pressing area N while rotating around an axis. The pressing roller 22 presses the toner on the sheet S passing through the pressing area N while rotating around an axis. Then, the toner image is fixed to the sheet S. The separation member 25 (separation plate 54) separates the sheet S that has passed through the pressing area N from the face of the fixing belt 21 in a state of being arranged at the contact position P20. Then, the sheet S on which the toner image is fixed is sent to the outside of the casing 20 and discharged to the sheet ejecting tray 4.

[Jamming Processing]

Figure 7:
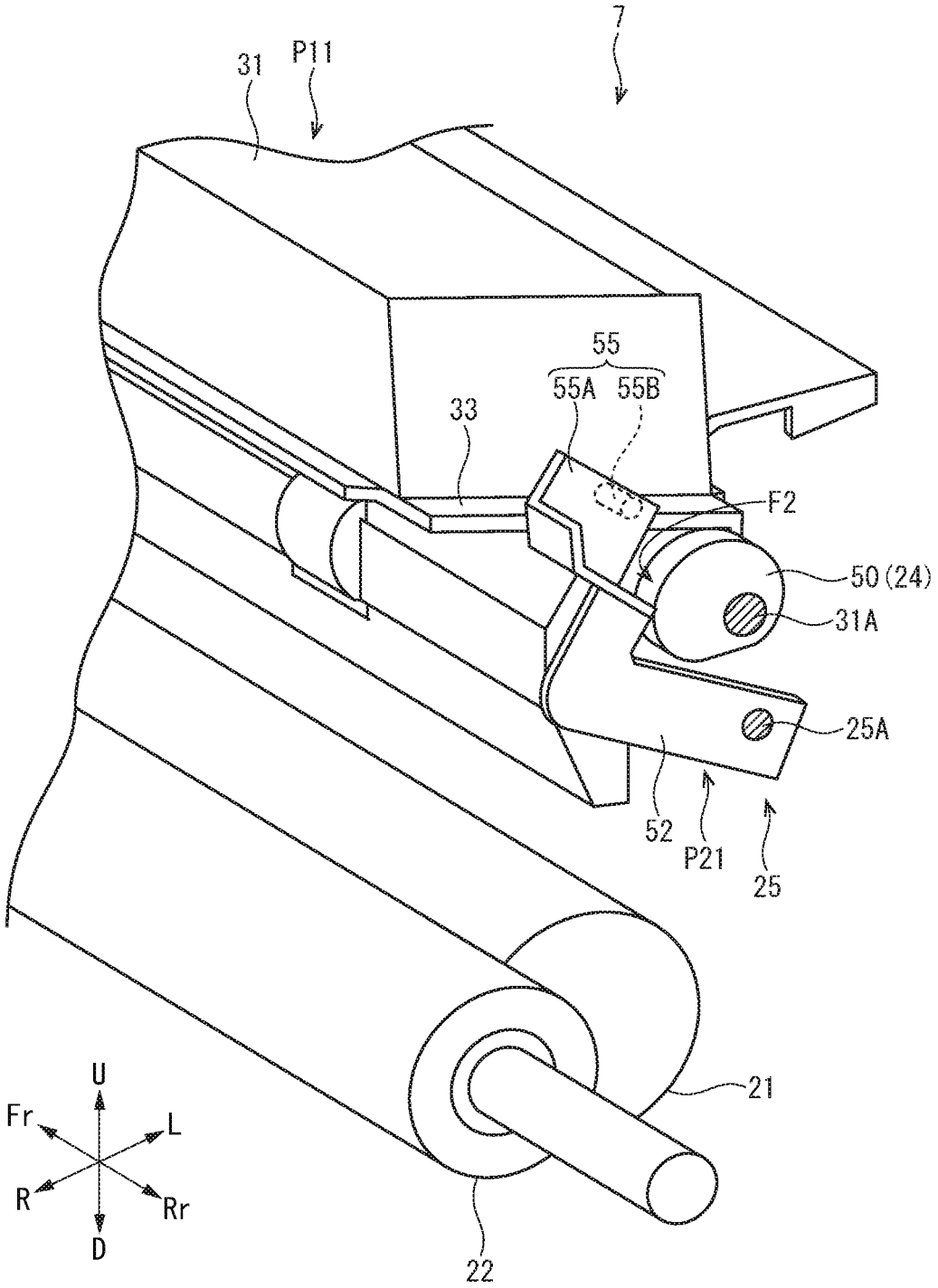
FIG. 7 is a perspective view illustrating the state in which the cover of the fixing device according to the one embodiment of the present disclosure is opened, viewed from the rear.
Figure 8:
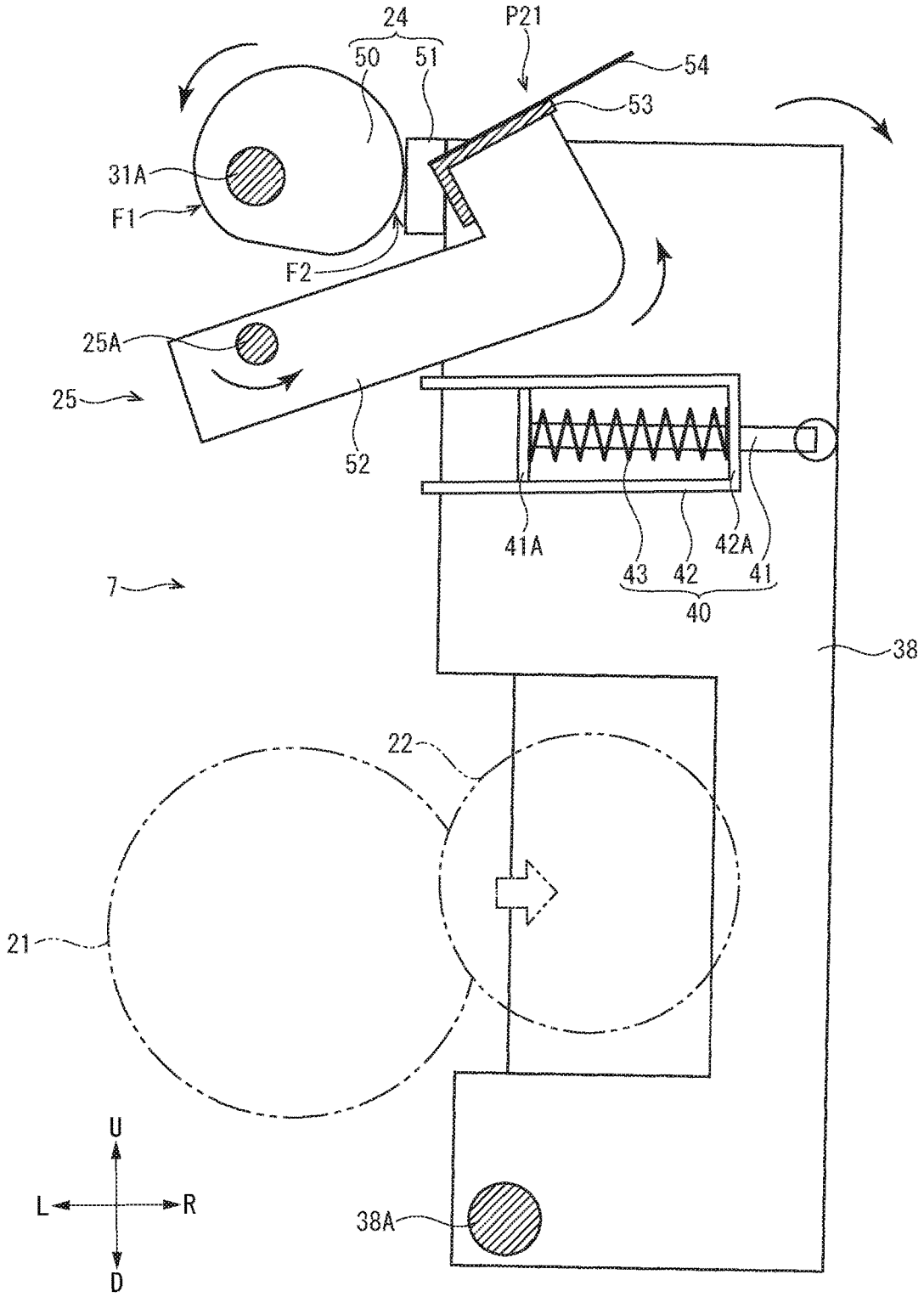
FIG. 8 is a front view schematically illustrating a state in which a separation member in the interior of the fixing device according to the one embodiment of the present disclosure is withdrawn.

Next, the jamming processing in the fixing device 7 will be described with reference to FIGS. 6 to 8. FIG. 7 is a perspective view illustrating the state in which the cover 31 of the fixing device 7 is opened, viewed from the rear. FIG. 8 is a front view schematically illustrating a state in which the separation member 25 in the interior of the fixing device 7 is withdrawn.

The color printer 1 detects conveyance failure (jamming) of the sheet S by using a detecting device (not illustrated)

appropriately arranged on the conveyance path 8. When the jamming occurs, the control device stops the image forming processing and displays a message indicating the occurrence of the jamming on a liquid crystal display (not illustrated). For example, when the jamming occurs in the casing 20 (pressing area N) of the fixing device 7, a user opens an opening-and-closing door (not illustrated) provided on the side face of the apparatus main body 2, and the jamming processing is executed as described below.

First, as illustrated in FIGS. 6 to 8, the user rotates the cover 31 upward around the opening-and-closing shaft 31A. The contact boss 55B of the separation member 25 is engaged with the cam part 33 of the cover 31 (see FIG. 4), so that the arm part 52 of the separation member 25 rotates upward around the separation shaft 25A in accordance with the rotation of the cover 31. In this case, the contact boss 55B moves upward while coming in contact with the cam part 33 (see FIG. 7). Thus, when the cover 31 rotates upward from the closing position P10 to the opening position P11, the separation member 25 (separation plate 54) rotates upward from the contact position P20 to the withdrawing position P21 while the contact part 55 is moving along the cam part 33. When the cover 31 rotates up to the opening position P11, the separation member 25 rotates and is positioned at the withdrawing position P21. When the separation member 25 is arranged at the withdrawing position P21, the tip end part of the separation plate 54 is placed in a state of entering the interior of the recess 31C of the cover 31 (see FIG. 6).

In addition, the pressure releasing part 24 sets the pressure of the pressing area N to the second pressure which is lower than the first pressure in a state in which the cover 31 is arranged at the opening position P11. Specifically, the eccentric cam 50 is fixed to the opening-and-closing shaft 31A of the cover 31, so that when the cover 31 rotates upward from the closing position P10 to the opening position P11, the eccentric cam 50 rotates with the opening-and-closing shaft 31A. Then, as illustrated in FIG. 8, the separation cam face F2 of the eccentric cam 50 comes in contact with the contact face part 51, which pushes the movable frame 38 to the right and causes the movable frame 38 to rotate clockwise around the rotating shaft 38A. This causes the pressing roller 22 to move in a direction in which the pressing roller 22 separates away from the fixing belt 21, which changes the pressure of the pressing area N from the first pressure to the second pressure.

As described above, the cover 31 is opened, and the tip end part of the separation plate 54 is withdrawn into the cover 31, and the pressing area N is brought into a state of being decompressed, so that the user can easily remove the sheet S clogged on the conveyance path 8 (pressing area N) in the casing 20.

After removing the sheet S, the user rotates the cover 31 downward from the opening position P11 to the closing position P10. Then, the separation member 25 (the arm part 52) rotates downward from the withdrawing position P21 to the contact position P20 by its own weight or the biasing force of the torsion coil spring. When the cover 31 rotates to the closing position P10, the separation member 25 rotates and is positioned at the contact position P20 (see FIG. 3). The eccentric cam 50 rotates with the opening-and-closing shaft 31A and causes the proximity cam face F1 to face the contact face part 51 (see FIG. 5). Then, pressing applied to the movable frame 38 by the eccentric cam 50 is released, and the movable frame 38 returns to its original position by the biasing force of the coil spring 43 (see FIG. 5). This changes the pressure of the pressing area N from the second pressure to the first pressure. As described above, the jamming processing is completed, and the image forming processing (fixing processing) can be executed again.

The fixing device 7 according to the present embodiment described above is configured such that the separation member 25 separates from the fixing belt 21 in synchronization with the operation of opening the cover 31, and the separation member 25 (the tip end part of the separation plate 54) comes in contact with the fixing belt 21 in synchronization with the operation of closing the cover 31. Further, the fixing device 7 is configured such that when the cover 31 is arranged at the opening position P11, the tip end part of the separation member 25 (the separation plate 54) is arranged in the recess 31C of the cover 31. With this configuration, the tip end part of the separation member 25 (the separation plate 54) moves until it enters the cover 31, so that space for performing the jamming processing can be obtained substantially (see FIG. 6). Thus, the sheet S clogged in the pressing area N can be visibly recognized in an appropriate manner, and the sheet S can be easily held and detached. In addition, the tip end part of the separation member 25 (the separation plate 54) is arranged in the recess 31C, so that the user's hands can be prevented from coming in contact with the tip end part of the separation member 25 during the jamming processing. This prevents the breakage of the separation member 25 during the jamming processing.

The fixing device 7 according to the present embodiment is configured to reduce the pressure of the pressing area N in synchronization with the operation of opening the cover 31 and increase the pressure of the pressing area N in synchronization with the operation of closing the cover 31, in addition to the movement of the separation member 25 in synchronization with the cover 31. With this configuration, the space for performing the jamming processing can be obtained substantially, and the pressing area N can be decompressed, so that the sheet S clogged (caught) in the pressing area N can be easily pulled out.

According to the fixing device 7 of the present embodiment, the operation of opening the cover 31 and the operation of separating the separation member 25 from the fixing belt 21 can be synchronously performed in an appropriate manner only by bringing the contact part 55 (contact boss 55B) into contact with the cam part 33 without using other motive power. Further, the eccentric cam 50 and the opening-and-closing shaft 31A rotate integrally, so that the operation of opening the cover 31 and the operation of separating the pressing roller 22 from the fixing belt 21 can be synchronously performed in an appropriate manner without using other motive power. This simplifies the configuration in which the cover 31, the separation member 25, and the pressure releasing part 24 move in synchronization with each other.

In the fixing device 7 according to the present embodiment, the fixing belt 21 that rotates around one axis has been used as one example of a fixing member, but the present disclosure is not limited to this. As another example of the fixing member, a fixing belt (not illustrated) that is provided across a plurality of rollers may be employed. Further, as another example of the fixing member, a fixing roller in which an elastic layer is stacked on the outer circumferential face of a metal core may be employed. In the fixing device 7 according to the present embodiment, the pressing roller 22 receives the driving force and rotates, but the present disclosure is not limited to this. The fixing belt 21 may receive the driving force and rotate, and the pressing roller 22 may be driven to rotate.

In the fixing device 7 according to the present embodiment, the pair of front and rear cam parts 33, the pair of front and rear eccentric cams 50, the pair of front and rear contact face parts 51, the pair of front and rear arm parts 52, and the pair of front and rear contact parts 55 are provided, but the present disclosure is not limited to this. Each one of the pairs may be provided in one of the front and rear directions. Further, it may be such that the torsion coil spring attached to the separation shaft 25A is omitted, and the separation member 25 rotates downward by its own weight.

In the explanation of the present embodiment, a case in which the present disclosure is applied to the color printer 1 is represented as one example, but the present disclosure is not limited to this. The present disclosure may be applied, for example, to a monochrome printer, a copying machine, a facsimile, or a multifunctional peripheral.

While the present disclosure has been described with reference to the particular illustrative embodiments, it is not to be restricted by the embodiments. It is to be appreciated that those skilled in the art can change or modify the embodiments without departing from the scope and spirit of the present disclosure.

The invention claimed is:

1. A fixing device comprising:

a fixing member to heat a toner on a medium while rotating;

a pressing member to form a pressing area between the fixing member and the pressing member while rotating and press the toner on the medium passing through the pressing area;

a cover to be movable between a closing position at which a conveyance path to convey the medium is formed and an opening position at which the conveyance path is exposed, the cover including a recess on a side of the conveyance path; and a separation member to be movable between a contact position at which the separation member comes in contact with a face of the fixing member in a state in which the cover is arranged at the closing position and a withdrawing position at which the separation member is separated from the fixing member in a state in which the cover is arranged at the opening position, wherein a cam part is formed at an end in an axial direction of the cover, the cover rotates around an opening-and-closing shaft extended in the axial direction, the separation member includes:

an arm to rotate around a separation shaft extended in an axial direction of the fixing member;

a separation plate to be fixed to a supporting member connected to the arm, a tip end of the separation plate coming in contact with the face of the fixing member; and a contact part to be provided at a tip end of the arm and to move while coming in contact with the cam part, the separation member separates the medium from the face of the fixing member in a state in which the separation member is arranged at the contact position, and a tip end part of the separation member enters an interior of the recess of the cover in a state in which the separation member is arranged at the withdrawing position.

2. The fixing device according to claim 1, further comprising a pressure releasing part to set pressure of the pressing area to first pressure under which the toner on the medium is pressed in the state in which the cover is arranged at the closing position and set the pressure of the pressing area to second pressure that is lower than the first pressure in the state in which the cover is arranged at the opening position.

3. The fixing device according to claim 2, wherein the pressure releasing part includes an eccentric cam, and the eccentric cam is fixed to an end in an axial direction of the opening-and-closing shaft and is contactable with a frame to support the pressing member, when the cover rotates upward from the closing position to the opening position, the separation member rotates upward from the contact position to the withdrawing position while the contact part is moving along the cam part, and the eccentric cam rotates with the opening-and-closing shaft and pushes out the frame, thereby changing the pressure of the pressing area from the first pressure to the second pressure.

4. The fixing device according to claim 1, wherein the separation shaft is arranged right below the opening-and-closing shaft.

5. The fixing device according to claim 1, further comprising a casing to support the fixing member, and wherein the opening-and-closing shaft and the separation shaft are supported by a side wall of the casing.

6. The fixing device according to claim 1, wherein the cover and the separation member are provided at a downstream side of the pressing area in a conveying direction of the medium.

7. An image forming apparatus comprising:

the fixing device according to claim 1.

* * * * *